US007322802B2

(12) United States Patent
Benckert et al.

(10) Patent No.: US 7,322,802 B2
(45) Date of Patent: Jan. 29, 2008

(54) THICK MATTER PUMP COMPRISING A CONVEYANCE CAPACITY CONTROL SYSTEM

(75) Inventors: Hartmut Benckert, Filderstadt (DE); Paul Von Baeumen, Sindelfingen (DE); Wolf-Michael Petzold, Aichwald (DE)

(73) Assignee: Putzmeister Aktiengesellschaft, Aichtal (DE)

( * ) Notice: Subject to any disclaimer, the term of this patent is extended or adjusted under 35 U.S.C. 154(b) by 537 days.

(21) Appl. No.: 10/494,183

(22) PCT Filed: Oct. 4, 2002

(86) PCT No.: PCT/EP02/11165

§ 371 (c)(1),
(2), (4) Date: Apr. 29, 2004

(87) PCT Pub. No.: WO03/033911

PCT Pub. Date: Apr. 24, 2003

(65) Prior Publication Data

US 2006/0153700 A1 Jul. 13, 2006

(30) Foreign Application Priority Data

Oct. 16, 2001 (DE) ..... 101 50 467

(51) Int. Cl.
*F04B 17/00* (2006.01)

(52) U.S. Cl. ..... 417/399; 417/401; 417/403; 417/900

(58) Field of Classification Search ..... 417/46, 417/399, 401, 403, 532, 900; 60/443, 431
See application file for complete search history.

(56) References Cited

U.S. PATENT DOCUMENTS

| | | | | |
|---|---|---|---|---|
| 3,707,990 | A * | 1/1973 | Schaible et al. | 137/615 |
| 5,226,800 | A | 7/1993 | Morino | |
| 5,344,290 | A * | 9/1994 | Benckert | 417/342 |
| 5,540,554 | A | 7/1996 | Masuzawa | |
| 5,967,756 | A * | 10/1999 | Devier et al. | 417/18 |
| 5,967,758 | A * | 10/1999 | Fujii et al. | 417/34 |
| 6,164,923 | A | 12/2000 | Mayer | |
| 6,171,075 | B1 | 1/2001 | Munzenmaier | |

FOREIGN PATENT DOCUMENTS

| | | |
|---|---|---|
| DE | 195 42 258 A | 5/1997 |
| DE | 196 35 200 A1 | 3/1998 |
| EP | 0 493 596 A | 7/1992 |

* cited by examiner

*Primary Examiner*—Anthony D. Stashick
*Assistant Examiner*—Jessica L Frantz
(74) *Attorney, Agent, or Firm*—Akerman Senterfitt; Stephan A. Pendorf; Yonghong Chen

(57) ABSTRACT

A thick matter pump comprising a drive motor (50), a (reversible) hydraulic pump (6), and two hydraulic cylinders (5, 5') coupled to conveyor cylinders (7, 7') for conveying the thick matter. A regulator regulates the rotational speed N of the drive motor (50), and a regulating clement (18, 20) regulates the displacement volume V of the hydraulic pump (6). A control module (54) regulates the rotational speed N of the motor and the displacement volume V. For improved operational ease and reduction of fuel requirements, noise and waste gas emission, the control module (54) comprises a final control element (56) for regulating the conveyance capacity of the conveyor cylinders (7, 7'), and an electronic control unit (108) which reacts to the position of the final control element (56) and allocates a nominal value to the rotational speed regulator and to the displacement volume regulator (20), in a software-assisted manner.

21 Claims, 4 Drawing Sheets

100%
F
0
56
108
N
P
N+
N-
V
100
104
80
82
54
101
102
103

M
50
25
52
74
75
75'
6
15
16
17
17'
18
20
95
70
70'
72
73
71
11
11'
100
101
102
103
104
21
21'
2
2'
7
7'
9
9'
1
1'
3
4
Y
Y'
10
x
xx
8
8'
5
5'
12
13
14
22
22'
30

2
1

114
56
F
read in F intended value
108
116
F <= EOC
No
124
calculate $N_{intended}$
Yes
100
101
122
100
N-
Yes
N > 1300 RPM
N+
No
RPM N< $N_{intended}$
118"
102
No
Yes
N-
RPM N>$N_{intended}$
103
Calculate V and output
102
100
126
120
103
Output 100% V
128
104
nein
Output limit reached
P
ja
130
103
Reduce V appropriately

THICK MATTER PUMP COMPRISING A CONVEYANCE CAPACITY CONTROL SYSTEM

CROSS REFERENCE TO RELATED APPLICATION

This application is a national stage of PCT/EP02/11165 filed Oct. 4, 2002 and based upon DE 101 40 467.5 filed Oct. 16, 2001 under the International Convention.

BACKGROUND OF THE INVENTION

1. Field of the Invention

The invention concerns a thick matter pump with a drive motor, preferably an internal combustion engine, with at least one hydraulic pump, preferably a reversible pump having a variable displacement volume, which can be coupled with the drive motor, with two hydraulic cylinders connected to the hydraulic pump and controlled in counter-stroke (push-pull manner), each coupled to a transport or conveyor cylinder, with a regulator for regulating the rotational speed of the drive motor and a regulating element associated with the hydraulic pump for regulating the displacement volume, and with a control module for setting the rotational speed of the motor and the displacement volume of the hydraulic pump.

2. Description of the Related Art

It is further known that in thick matter pumps of this type the conveyor cylinders can be alternatively coupled to a conveyor line via a pipe switch or shunt, wherein the conveyor line is routed along a distribution boom, which is hydraulically operable via a hydraulic pump, and is preferably in the form of an articulated boom.

In mobile concrete pumps it is known (DE-A 196 35 200) to use, in the pumping operation, the already present vehicle motor and the vehicle transmission for driving the hydraulic pump. For this purpose, a power drive transmission or distributor gear is generally provided in the cardanic shaft line of the vehicle, which can be selectively switched between vehicle propulsion and pump operation. During pump operation the transport or conveyance volume of the thick matter pump can be adjusted by varying of the rotational speed of the drive motor. It is further known (DE-A 195 42 258) to use, for the control of the hydraulic cylinders of the thick matter pump, a hydraulic pump with variable displacement volume. With a given motor rotational speed, the conveyance amount can be adjusted by regulating the displacement volume of the hydraulic pump. The known hydraulic pumps are preferably in the form of axial piston pumps with slant disks, of which the displacement volume can be varied by adjustment of the slant angle of the slant disk. The adjustment of the slant disk slant angle occurs for example via an adjustment cylinder, which for its part is controllable via a proportional valve. The pump operator thus has available to him therewith selectively two regulating means, each independent from the other, for adjusting the desired thick matter conveyance amount. In order to complete the pumping operation as quickly as possible, in practice the motor is frequently operated at maximum rotational speed, with the regulation of the amount being accomplished by adjusting the displacement volume alone. Therein it is not taken into consideration that the specific fuel consumption of the drive motor is dependent primarily upon the motor rotational speed, and that the high rotational speed also increases the sound emissions and exhaust gas emissions.

SUMMARY OF THE INVENTION

Beginning therewith, it is the task of the present invention to improve the known thick matter pump with conveyance regulation of the above described type in such a manner, that for a specific conveyance amount both the fuel consumption as well as the noise and exhaust gas emissions are reduced.

For accomplishing this task the combination of characteristics set forth in Patent Claim 1 is proposed. Advantageous embodiments and further developments of the invention can be found in the dependent claims.

The inventive solution is based upon the idea, that a control module is provided, comprising a final control element or actuator for setting the thick matter conveyance capacity (F), preferably a potentiometer, as well as an electronic control unit which reacts to the position of the final control element for the software supported specifying of the intended value for the regulator of the motor rotational speed and the regulating element regulating the displacement volume.

A preferred embodiment of the invention envisions that the control logic or its software includes an idle running or no load operation routine for setting a defined no load rotational speed of the drive motor in the case of decoupled hydraulic pump. The no load rotational speed is preferably 20 to 50% of a predetermined maximal rotational speed.

A further preferred embodiment of the invention envisions that the control logic or its software includes a base load or utility load factor component for setting a defined base load rotational speed of the drive motor when coupled to the hydraulic pump.

The base load routine is activated once when, via the final control element, a regulating value of greater than zero ($F>0$) is input and a pumping process is initiated. The base load rotational speed remains in this case preferably constant over a predetermined range of settings of the final control element, wherein the regulating value (F) of the final control element forms a desired value or set value for the displacement volume regulating element of the hydraulic pump.

Preferably the base load routine is also activated in the case of the zero setting of the final control element ($F=0$), when the distribution boom is activated. Thereby it is achieved, that during boom operation, even without a pumping process, a sufficient movement speed of the distribution boom is achieved, which could not be achieved at only the no-load rotational speed of the drive motor.

The base load rotational speed preferably corresponds to 65 to 80% of a predetermined maximal rotational speed. It has been found particularly advantageous when the base load routine is activated in the setting range below 65 to 80% of the final control element.

A further preferred embodiment of the invention envisions that the control logic or its software includes a peak load routine for adjusting a defined displacement volume of the hydraulic pump, wherein the displacement volume remains constant over a predetermined setting range of the final control element and the regulating value of the final control element forms an intended value target for the rotational speed controller above the base load rotational speed. The peak load routine is preferably activated in an adjustment range above a predetermined regulating value of 65 to 80% of the final control element.

A preferred embodiment of the invention envisions that, via the peak load routine, during maximal displacement volume of the hydraulic pump, rotational speeds between the base load rotational speed and a predetermined maximal rotational speed are regulated according to the value of a conveyance amount regulated by the final control element. The maximal rotational speed is preferably greater than 1,700 RPM.

In order to prevent an overload of the system, it is proposed in accordance with a further preferred embodiment of the invention that a sensor is provided on the pressure side of the hydraulic pump for detecting the hydraulic pressure and/or the pump output, and that the control module or its software includes a limiting routine responsive to a predetermined pressure or output value for reducing the displacement volume.

BRIEF DESCRIPTION OF THE DRAWING

In the following the invention will be described in greater detail on the basis of the figures. There is shown FIG. 1*a* a hydraulic flow diagram of a two cylinder thick matter pump.

DETAILED DESCRIPTION OF THE INVENTION

Figures 1A, 1B:
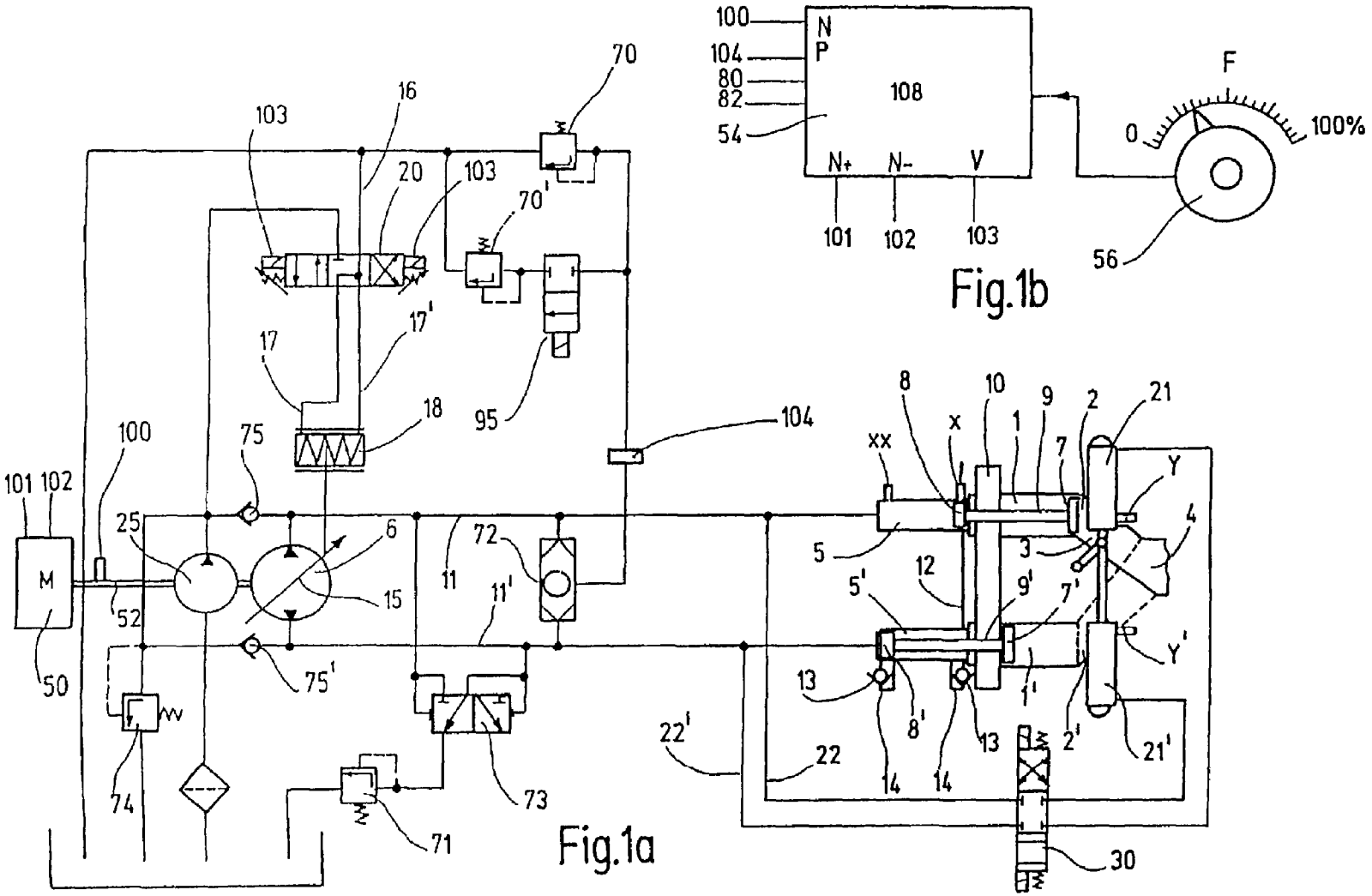
FIG. 1*b* a schematic of a control module for regulating the conveyance amount in the thick matter pump according to FIG. 1*a*.

The hydraulic flow diagram shown in FIG. 1 is designed for a thick matter pump, which includes two conveyor cylinders 1, 1', of which the end openings 2, 2' open into not shown material supply containers, and which are alternatively in communication, via the pipe switch 3, with a conveyance line 4 during the pressure stroke. In a thick matter pump, which here is a concrete pump, the conveyance line continues along a not shown hydraulically operated concrete distribution boom which is preferably in the form of an articulated boom. The conveyor cylinders 1, 1' are operated in counterstroke via the hydraulic cylinders 5, 5' and the reversible hydraulic pump 6 which in the illustrated embodiment is in the form of a slant disk axial piston pump. For this purpose the conveyor pistons 7, 7' are connected with the drive pistons 8, 8' of the hydraulic cylinders 5, 5' via a common piston rod 9, 9'. Between the conveyor cylinders 1, 1' and the hydraulic cylinders 5, 5' there is a water chest 10 through which the piston rods 9, 9' extend.

In the shown illustrative embodiment the drive cylinders 5, 5' are acted upon on their base side by hydraulic oil via the hydraulic lines 11, 11' of the main flow circuit by means of hydraulic pump 6 and are connected hydraulically with each other via a rocker hydraulic line 12. For the purpose of stroke correction, there is provided on both ends of the hydraulic cylinders 5' of each of the concerned drive pistons 8' a pressure equalization line 14 containing a check valve or non-return valve 13 bridging over the end position.

The direction of movement of the drive pistons 8, 8', and therewith the conveyor pistons 7, 7', is reversed thereby, that the slant disks 15, 15' of the reversing pump 6, triggered by a reverse signal, pivot through their zero position and therewith change the direction of conveyance of the hydraulic oil in the hydraulic lines 11, 11' of the hydraulic flow circuit. The operating of the conveyance direction of the reversing pump 6 determining main control valve 20 occurs via the electrically picked off end position signal x and xx of the drive cylinder 5. The displacement volume V of the reversing pump 6, and therewith the hydraulic conveyance amount, is determined by the slant angle of its slant disk 15, 15' and by the rotational speed N of the drive motor 50, which is preferably a diesel motor. The slant disk angle is adjustable proportional to a control pressure, which operates via the lines 17 and 17' and the proportional valve 20 of the control cylinder 18 located in the relevant circuit or flow path. The high pressure level can be changed or changed over depending upon the value of the switch or circuit condition of the thick matter pump via the blocking or closing valve 95 and the two pressure limiting valves 70, 70' while, for adjusting the low pressure level, a pressure regulator 71 is provided. The control inputs for the hydraulic cylinders are connectable with the respective high pressure or, as the case may be, low pressure conveying lines 11, 11' of the main circuit via the switch or rocker valve 72 or, as the case may be, a directional valve 73 in the form of a rinse or flush valve.

The auxiliary pump 25 charges the closed main flow circuit via the check valve 75, 75' and is protected by high pressure limiting valve 74.

The change over of the pipe switch 3 occurs via the hydraulic cylinders 21, 21' which are in the form of a plunger cylinders, which are acted upon directly with the hydraulic fluid conveyed from the reversing pump 6 through the control lines 22, 22' branched off from the hydraulic lines 11, 11' of the main flow circuit and the reversing valve 30.

For setting the conveyance amount of the thick matter pump two basic parameters are available: The rotational speed N of the drive shaft 52 of the drive motor 50 coupled with the hydraulic pump 6 and the displacement volume V of the hydraulic pump 6 defined by the angular position of the slant disk 15 of the hydraulic pump 6. The setting of this parameter occurs via a control module 54, which is integrated into a radio control device operable by the pump operator. To adjusting the conveyed amount F a final control element 56 in the form of a potentiometer is available to the pump operator, which can be adjusted by hand between the positions 0 and 100%. In the 0 position no concrete is conveyed, while in the 100% position the maximal conveyance amount is selected. In each intermediate position a corresponding proportion of the maximal conveyance amount is conveyed corresponding to the indicated percentile position. The control module further includes a control logic 108 responsive to the setting of the final control element 56 for the software supported target value input for the rotational speed regulator of the motor 50 and for the angular position of the slant disk 15 which defines the displacement volume of the hydraulic pump 6. The actual regulation of the rotational speed occurs in the control module 54. For this, the control module 54 obtains the actual rotational speed from a rotational speed gauge or meter 100 and is connected via outputs 101 and 102 with the inputs N+ and N− of the motor N. Herein N+ means "give gas", N− means "reduce gas". In the regulating element 20 for the adjustment of the displacement volume of the hydraulic pump 6, it is in this case a proportional valve, via the different path positions simultaneously the strokewise reversing of the hydraulic pump occurs between the two drive cylinders 5, 5'. For adjusting the displacement volume V a control module 54 is connected via connection 103 to the electromagnets of the electrically operated proportional valve 20. The valve current reaching the connections 103 is calculated in the control logic 108 via the control software and is set by pulse width modulation. The control module 54 includes besides this also a connection 104 for a pressure sensor in the hydraulic circuit, which provides supplemental pressure information P for output control and pressure limitation.

The control software is described in greater detail in the following on the basis of the flow diagram shown in FIG. 2*a,b*. The program includes multiple branches, which in the following will be referred to as "routines". The pump 6 can be switched on and off using the remote control via a not shown switch. The activation condition of the pump is recognized in the control module by a signal at input 80. The control module 54 obtains a signal regarding the operating condition of the distribution boom via a further input 82.

In the case of switched off pump, switched off boom operation and an input value F=0 at the final control element 56 the software question 110 leads, over the output path "no", to a no-load routine 112, via which a defined no-load rotational speed of the drive motor of N=850 RPM is set. The adjustment of the rotational speed occurs by a control parameter N− at the connection 102 (FIG. 1). The no-load rotational speed ensures that the motor overcomes the no-load friction, without stalling.

Upon activation of the pump 6 (input 80) or during boom operation (input 82) or during operation of the control element 56 the control logic or it's software 108 arrives, via the "yes" path of the question 110, to the base-load routine 118', in which the rotational speed of the motor is increased by giving gas (N+) up to the base-load rotational speed N=1,300 RPM. This rotational speed is selected, for example, for a particular type of motor, depending upon the value of a minimal fuel consumption for a sufficient torque for the trouble-free operation of the pump. After reaching the base-load rotational speed it is checked in the software branch 115 whether mast operation is occurring without pump operation. If this is the case ("yes" at 115), then the questioning is ended and the program jumps back to program start 110.

In the case that the pump is switched on ("no" at 115) then the control software reaches branch 114, which ensures that next the intended value F set at the control means 56 is read and compared in the software branch 116 with a preset benchmark value EOC. So long as the regulating value F is below the benchmark value EOC ("yes"), the second branch of the base-load routine 118" is run, wherein the base-load rotational speed N=1,300 RPM is here set by reduction of gas (N−). Then the valve current for the connections 103 of the proportional valve 20 are calculated to provide an output or flow depending on the value of the conveyance amount F set at final control element 56 in the program part 120. The adjusted valve current determines the displacement volume V of the pump 6. The valve flow or path can be increased so long until the hydraulic pump 6 is adjusted to the greatest tilt angle, in which case the pump 6 is operating with the greatest displacement volume (V=100%). As soon as the adjustment value F of the adjustment body 56 exceeds the EOC benchmark value, then the control software enters into the area of the peak-load routine 122, in which with maximal displacement volume V of the pump 6 a further increase in the conveyance amount is achieved by increasing rotational speed N of the motor. The respective rotational speed is calculated in the program area 124 with development of the value $N_{intended}$ and is matched with the measured actual value by controlling the motor input N+ or as the case may be N−. At the same time the maximal displacement volume (V=100%) is maintained via the program part 126.

The program parts 120 and 126 are connected at their output side with a check routine 128, in which it is checked with evaluation of the pressure signal P detected with the sensor 104 whether a predetermined output pressure limit is reached. In the case "yes" the valve flow in the proportional valve 103 is reduced for adjusting the displacement volume V in the program part 130, if "no" the instantaneous set displacement volume V remains maintained. From there, a return to the program start 110 occurs. There the next program part is initiated.

Figure 2A:
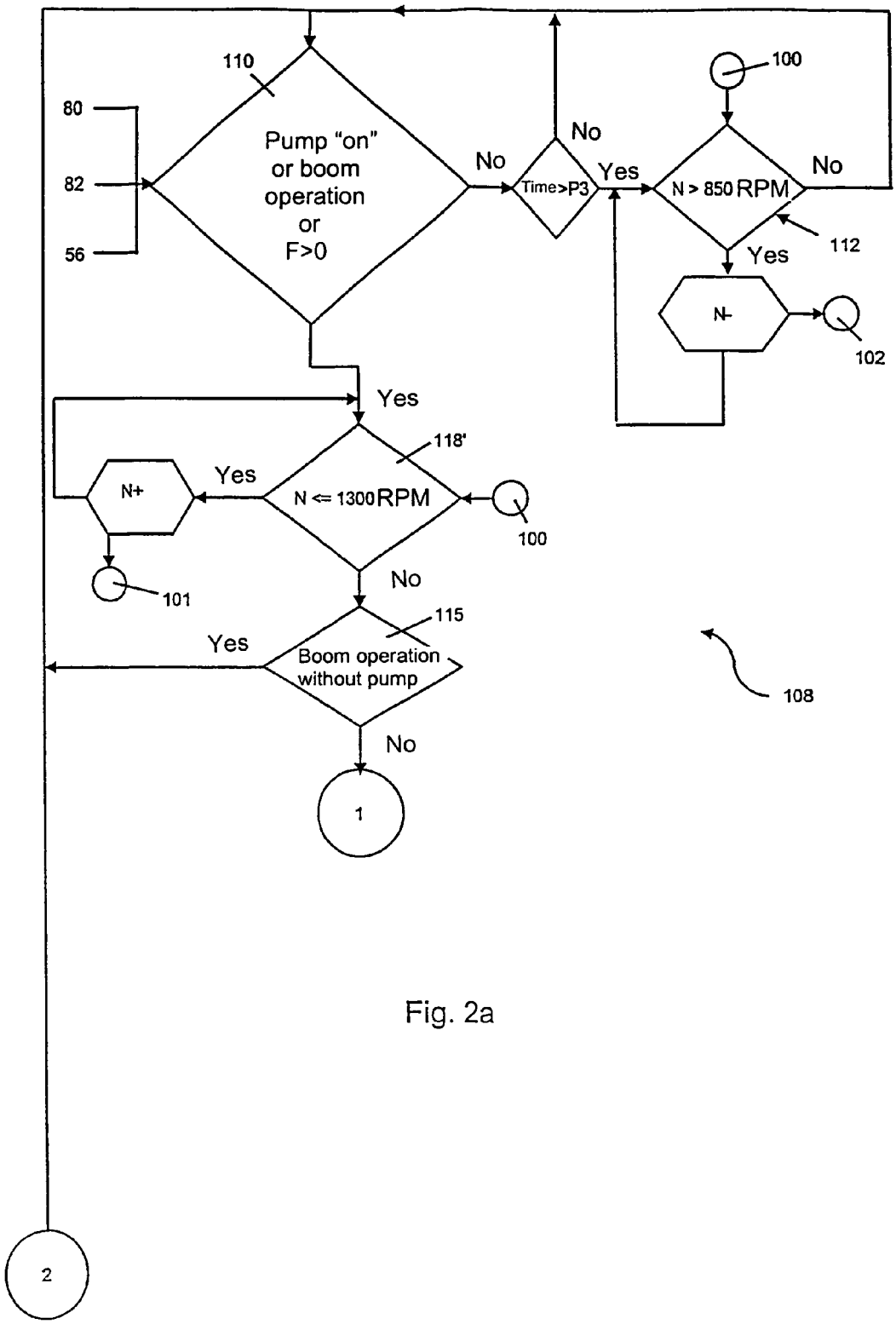
FIGS. 2*a* and *b* a flow diagram of a control software for the regulation of the conveyance amount.
Figure 2B:
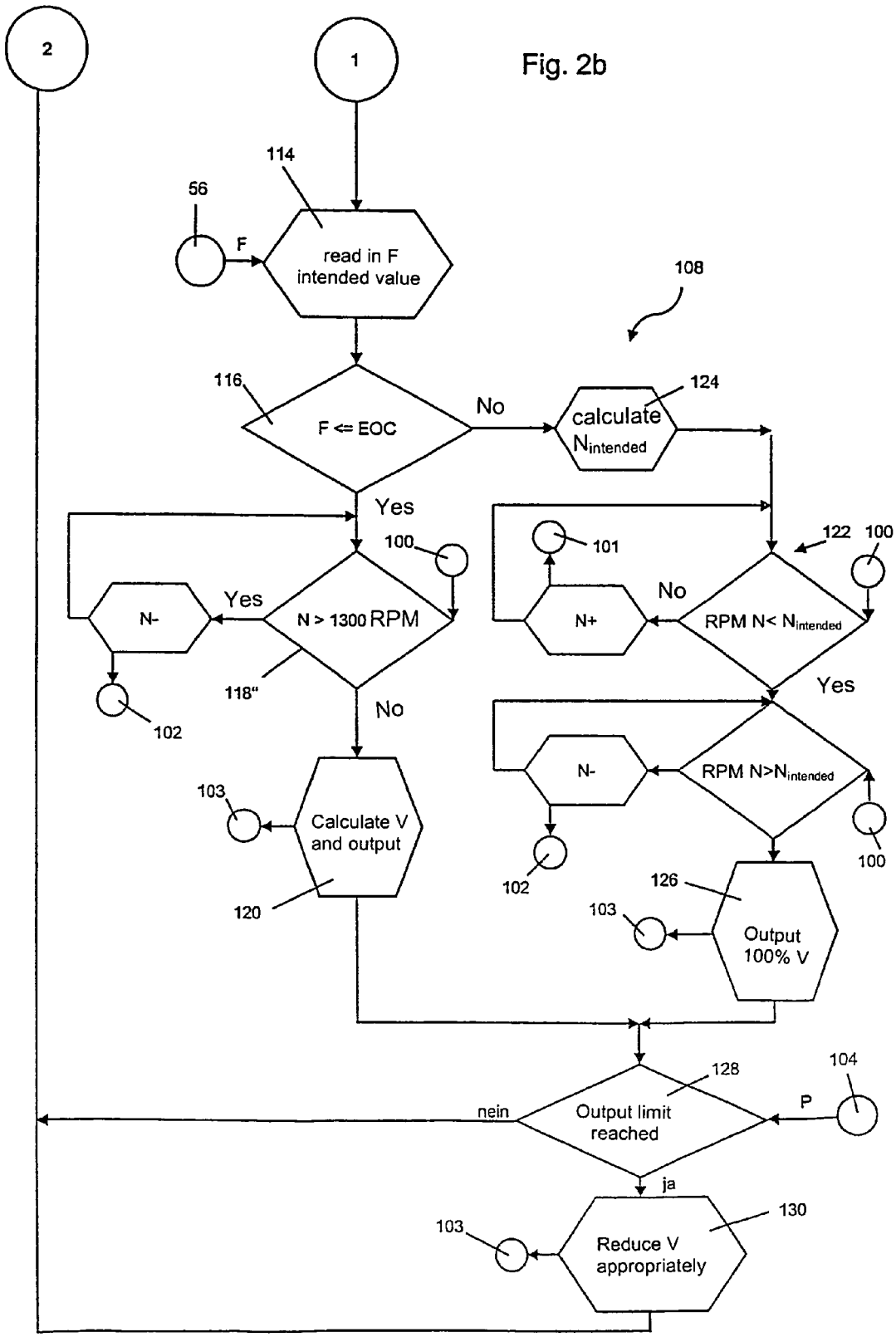
Figure 3:
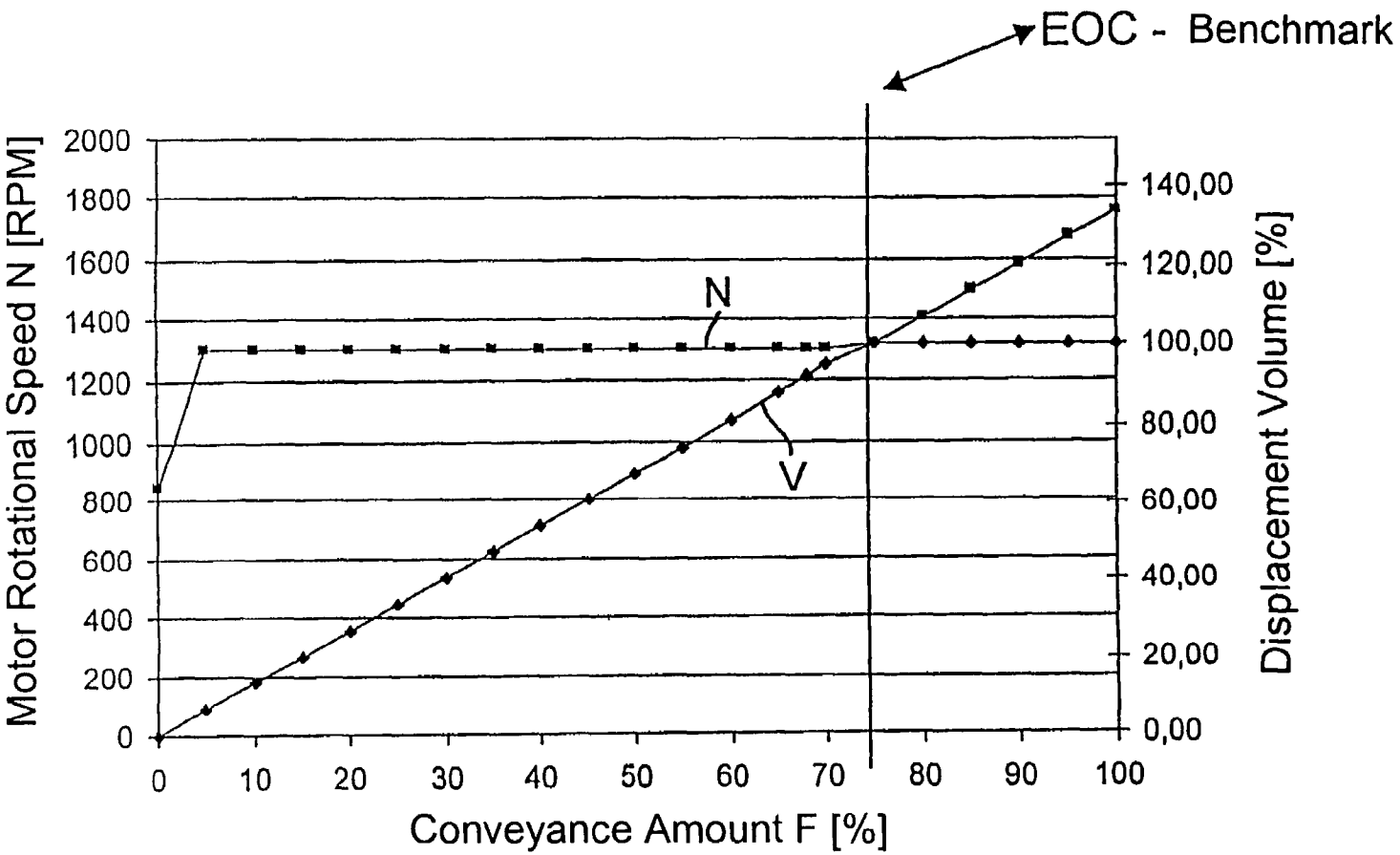
FIG. 3 a diagram which shows the motor rotational speed and the relative displacement volume of the hydraulic pump depending upon the setting or control of the final control element for the thick matter conveyance amount.

The program defined by the flow diagram according to FIGS. 2*a* and *b* leads to the shown intended value running of the motor rotational speed N shown in the diagram according to FIG. 3 and the displacement volume V depending upon the adjustment of the displacement amount F at final control element 56. The pump motor, in the case that the conveyance amount F=0, starts with the no-load rotational speed of 850 RPM and is adjusted to the base-load rotational speed of 1,300 RPM upon switching on of the pump (curve N with quadratic measurement points). During adjusting of the final control element 56 the motor rotational speed is maintained constant at the base-load value, while the displacement volume V is increased linearly with the control value F of the control body 56. Upon reaching the EOC benchmark value (F=74%) the displacement volume of the pump is set to V=100%. From there onwards, an increase in the conveyed amount is achieved exclusively by increasing the motor rotation speed N, until the maximum conveyance amount (F=100%) is achieved at a rotational speed of approximately 1,750 RPM.

In summary, the following can be concluded: The invention relates to a thick matter pump comprising a conveyance capacity control system. Said thick matter pump comprises a drive motor 50 which is preferably embodied as an internal combustion engine, a hydraulic pump 6 which is preferably embodied as a reversible pump, which has a variable displacement volume V and can be coupled to the driving motor, and two hydraulic cylinders 5, 5' which are connected to the hydraulic pump 6, can be controlled by the same in a push-pull manner, and are each coupled to a conveyor cylinder 7, 7' for conveying the thick matter. A regulator for regulating the rotational speed N is associated with the drive motor 50, and a regulating element 18, 20 for regulating the displacement volume V is associated with the hydraulic pump 6. A control module 54 is also provided for regulating the rotational speed N of the motor and the displacement volume V. According to the invention, the control module 54 comprises a final control element 56 for regulating the thick matter conveyance capacity F of the conveyor cylinders 7, 7', and an electronic control unit 108 which reacts to the position of the final control element 56 and allocates a nominal value to the rotational speed regulator and to the displacement volume regulator 20, in a software-assisted manner. These measures enable improvement of the operational ease of the thick matter pump, and reduction of fuel requirements, noise emission and waste gas emission during practical use.

The invention claimed is:

1. A thick matter pump comprising:

a drive motor (50), a variable displacement hydraulic pump (6) coupelable to the drive motor, two hydraulic cylinders (5, 5') connected to the hydraulic pump and driven in counterstroke, one conveyor cylinder (7, 7') coupled respectively to each hydraulic cylinder, a rotational speed regulator for regulating the rotational speed of the drive motor, a displacement volume regulator (20) associated with the hydraulic pump for regulating the displacement volume, and a control module (54) for regulating the thick matter conveyance capacity by regulating (a) the rotational speed of the motor and (b) the displacement volume of the hydraulic pump via the rotational speed regulator and the displacement volume regulator (20), wherein the control module (54) includes a final control element (56) for selecting the desired thick matter conveyance capacity (F) of the conveyor cylinders (7, 7') and an electronic control unit (108) which reacts to the position of the final control element (56) and allocates a nominal value to the rotational speed regulator and to the displacement volume regulator (20) in a software assisted manner, wherein the electronic control unit (108) or its software includes a base-load routine (118, 118') for adjusting a defined base-load rotational speed of the drive motor (50) in the case of coupling to the hydraulic pump (6), wherein the base load rotational speed remains at a constant rotational speed below a predetermined maximum rotational speed over a predetermined adjustment range of the final control element (56) and wherein when the base load rotational speed is at the constant rotational speed the adjustment value (F) of the final control element (56) provides an intended value input for the displacement volume (V) of the hydraulic pump (6).

2. A thick matter pump according to claim 1, wherein the final control element (56) is a potentiometer.

3. A thick matter pump according to claim 1, wherein the conveyor cylinders (7, 7') are alternatively coupleable to a conveyance line (4) via a pipe switch (3), runs along a distribution boom, preferably an articulated boom, which is hydraulically operated via a hydraulic pump (6), thereby characterized, that the base-load routine (118, 118') is activated in the case that the distribution boom is switched on even in the case of the zero position of the final control element (56) and/or the case of the switched off pump operation.

4. A thick matter pump according to claim 1, wherein the baseload rotation speed corresponds to 65 to 80% of a predetermined maximal rotational speed.

5. A thick mailer pump according to claim 1, wherein the base load rotational speed is selected to be a constant value (N) between 1,200 and 1,500 RPM.

6. A thick matter pump according to claim 1, wherein the base-load routine (118) is activated in an adjustment area below 65 to 80% of the final control element (56).

7. A thick matter pump according to claim 1, wherein the electronic control unit (108) or its software includes a peak-load routine (122) for adjusting a defined displacement volume (V) at the hydraulic pump (6), wherein over a predetermined adjustment range of the final control element (56) the displacement volume (V) remains constant and the regulating value (F) of the final control element (56) forms an intended value ($N_{intended}$) for the drive motor rotational speed regulator above the base-load rotational speed.

8. A thick matter pump according to claim 1, wherein a sensor (104) is provided on the pressure side of the hydraulic pump for detecting the hydraulic pressure (P) and/or the pump output, and that the control module (54) or its software (108) includes a limiting routine (128) responsive to the measured pressure or output value (N) for reducing the displacement volume (V) in the case of exceeding a predetermined limitation value.

9. A thick matter pump according to claim 1, wherein the electronic control unit (108) or its software includes a no-load routine (112) for setting a defined no-load rotational speed of the drive motor (50) in the case that the hydraulic pump (6) is decoupled.

10. A thick matter pump according to claim 1, wherein said drive motor is an internal combustion engine.

11. A thick matter pump according to claim 1, wherein said pump is a reversible pump.

12. A thick matter pump comprising:

a drive motor (50), a variable displacement hydraulic pump (6) coupelable to the drive motor, two hydraulic cylinders (5, 5') connected to the hydraulic pump and driven in counterstroke, one conveyor cylinder (7, 7') coupled respectively to each hydraulic cylinder, a rotational speed regulator for regulating the rotational speed of the drive motor, a displacement volume regulator (20) associated with the hydraulic pump for regulating the displacement volume, and a control module (54) for regulating the thick matter conveyance capacity by regulating (a) the rotational speed of the motor and (b) the displacement volume of the hydraulic pump via the rotational speed regulator and the displacement volume regulator (20).

wherein the control module (54) unit includes a final control element (56) for selecting the desired thick matter conveyance capacity (F) of the conveyor cylinders (7, 7') and an electronic control unit (108) which reacts to the position of the final control element (56) and allocates a nominal value to the rotational speed regulator and to the displacement volume regulator (20) in a software assisted manner, wherein the electronic control unit (108) or its software includes a peak-load routine (122) for adjusting a defined displacement volume (V) at the hydraulic pump (6), wherein over a predetermined adjustment range of the final control element (56) the displacement volume (V) remains constant and wherein the regulating value (F) of the final control element (56) forms an intended value ($N_{intended}$) for the drive motor rotational speed regulator above a base-load rotational speed.

13. A thick matter pump according to claim 12, wherein a peak load routine (122) is activated in an adjustment range above a regulation value of 65 to 80% of the final control element (56).

14. A thick matter pump according to claim 12, wherein via the peak load routine (122), in the case of maximum displacement volume (V) of the hydraulic pump (6), rotational speeds between the base-load rotational speed and a predetermined maximal rotational speed can be set depending upon the value of the conveyance amount (F) input at the final control element (56).

15. A thick matter pump according to claim 14, wherein the predetermined maximal rotational speed is at least 1,700 RPM.

16. A thick matter pump according to claim 12, wherein a sensor (104) is provided on the pressure side of the hydraulic pump for detecting the hydraulic pressure (P) and/or the pump output, and that the control module (54) or its software (108) includes a limiting routine (128) responsive to the measured pressure or output value (N) for reducing the displacement volume (V) in the case of exceeding a predetermined limitation value.

17. A thick matter pump according to claim 12, wherein the electronic control unit (108) or its software includes a no-load routine (112) for setting a defined no-load rotational speed of the drive motor (50) in the case that the hydraulic pump (6) is decoupled.

18. A thick matter pump according to claim 17, wherein the no-load rotational speed corresponds to 20 to 50% of a predetermined maximal rotational speed.

19. A thick matter pump according to claim 17, wherein the no-load rotational speed is 700 to 900 RPM.

20. A thick matter pump according to claim 12, wherein said drive motor is an internal combustion engine.

21. A thick matter pump according to claim 12, wherein said pump is a reversible pump.

* * * * *